US008220501B2

(12) United States Patent
Settelmeyer et al.

(10) Patent No.: US 8,220,501 B2
(45) Date of Patent: Jul. 17, 2012

(54) METHOD FOR SAFE FILLING IN VALVE-CONTROLLED FILLING SYSTEMS

(75) Inventors: Rüdiger Settelmeyer, Burgdorf (DE); Richard Heyne, Muesbach-le-haut (FR)

(73) Assignee: Endress + Hauser Process Solutions AG, Reinach (CH)

( * ) Notice: Subject to any disclaimer, the term of this patent is extended or adjusted under 35 U.S.C. 154(b) by 519 days.

(21) Appl. No.: 12/084,138

(22) PCT Filed: Oct. 17, 2006

(86) PCT No.: PCT/EP2006/067517

§ 371 (c)(1),
(2), (4) Date: Dec. 14, 2009

(87) PCT Pub. No.: WO2007/048742

PCT Pub. Date: May 3, 2007

(65) Prior Publication Data

US 2010/0108178 A1 May 6, 2010

(30) Foreign Application Priority Data

Oct. 28, 2005 (DE) ..... 10 2005 052 197

(51) Int. Cl.
*B65B 1/04* (2006.01)

(52) U.S. Cl. ..... 141/1; 141/213

(58) Field of Classification Search ..... 141/1, 7, 141/213, 46, 59, 198, 293, 301
See application file for complete search history.

(56) References Cited

U.S. PATENT DOCUMENTS

| | | | | |
|---|---|---|---|---|
| 3,507,308 | A * | 4/1970 | White | 141/7 |
| 4,697,622 | A * | 10/1987 | Swift et al. | 141/1 |
| 6,189,578 | B1 * | 2/2001 | Clusserath | 141/7 |
| 7,011,120 | B2 * | 3/2006 | Nakabayashi et al. | 141/302 |
| 2002/0000259 | A1 | 1/2002 | Suzuki | |

FOREIGN PATENT DOCUMENTS

| | | | |
|---|---|---|---|
| DE | 101 49 473 | A1 | 4/2003 |
| WO | WO 97/00224 | | 1/1997 |
| WO | WO 2004/051200 | A1 | 6/2004 |

* cited by examiner

*Primary Examiner* — Davis Hwu
(74) *Attorney, Agent, or Firm* — Bacon & Thomas, PLLC

(57) ABSTRACT

A method for the safe filling of a product in valve-controlled filling systems having, at individual filling stations, flow measuring devices for determining the amount of filling of the product being filled, a flow value D(ti) is determined for a number of time intervals at opened filling valve and checked for significant deviations brought about by air bubble formation in the product being filled. If significant deviations occur, then the pertinent filling valve is closed prematurely.

6 Claims, 2 Drawing Sheets

METHOD FOR SAFE FILLING IN VALVE-CONTROLLED FILLING SYSTEMS

TECHNICAL FIELD

The invention relates to a method, for safe filling in valve-controlled filling systems, having, at individual filling stations, flow measuring devices for determining the filling amount of product being filled.

BACKGROUND DISCUSSION

In various branches of industry, valve-controlled filling systems are applied for filling liquid products into containers. The containers are, most often, bottles. Problematic, in such case, is, frequently, foam formation during the filling process. If the product being filled is a liquid soap, for example, hair shampoo, then foam formation, which is caused by air bubbles during the filling, can easily bring about an overflow of the shampoo bottle during the filling event. Overflow even at a single filling station can cause the shutdown of the entire filling system. Depending on how much product has overflowed, extensive cleaning measures may be necessary.

The amount of product filled in each filling event is frequently measured with flow measuring devices (e.g. Dosimass, Dosimag, of the firm, Endress+Hauser) and adjusted via a metering control-unit.

If air bubbles occur during a filling event, then the flow measurement is more or less disturbed, depending on the measuring principle. The flow values delivered by the measuring device deviate from the actually present flow. In the case of Coriolis, mass flow measuring devices and in the case of magneto-inductive, flow measuring devices, complex methods are known for air bubble detection. These complex evaluating methods, however, require a certain amount of time, before the device can figure out that air bubbles are present and then display such information e.g. on its status output. For fast filling events, with filling times under a second, such bubble detecting methods are not appropriate.

SUMMARY OF THE INVENTION

An object of the invention is, therefore, to provide a method for safe filling in the case of valve-controlled filling systems, which method does not have the above mentioned disadvantages, while, especially, preventing overflow during the filling process due to air bubble formation and being easy and cost-favorable to implement.

This object is achieved by A method for safe filling in valve-controlled filling systems having, at individual filling stations, flow measuring devices for determining the amount of filling of the product being filled, characterized by the following method steps: opening a filling valve at a point in time T0; determining a flow value D(ti) at the opened filling valve for a plurality of time intervals t1, t2, . . . tn; checking the flow values D(ti) for significant deviations brought about by air bubble formation in the product being filled; closing the filling valve at a point in time T1, when no significant deviations occur; and closing the filling valve at a point in time T1'≦T1, when significant deviations occur.

An essential idea of the invention is to detect, rapidly and easily, the formation of air bubbles in the product being filled at a filling station, such as can cause overflow during a filling event, by evaluating a number of flow values D(ti) at times when a constant flow should exist at the filling station.

In case significant deviations are detected in the flow, the relevant filling valve is closed prematurely.

The flow measuring devices can be e.g. Coriolis, or magneto-inductive, flow measuring devices.

The invention is suited, especially, for filling operations characterized by fast filling events, where the time period between opening and closing of the filling valve lies below 1-5 seconds.

In a further development of the invention, pulses on a pulse output of the flow measuring devices are used for determining instantaneous flow value.

BRIEF DESCRIPTION OF THE DRAWINGS

The invention will now be explained in greater detail on the basis of an example of an embodiment presented in the drawing, the figures of which show as follows.

DETAILED DISCUSSION IN CONJUNCTION WITH THE DRAWINGS

Figure 1:
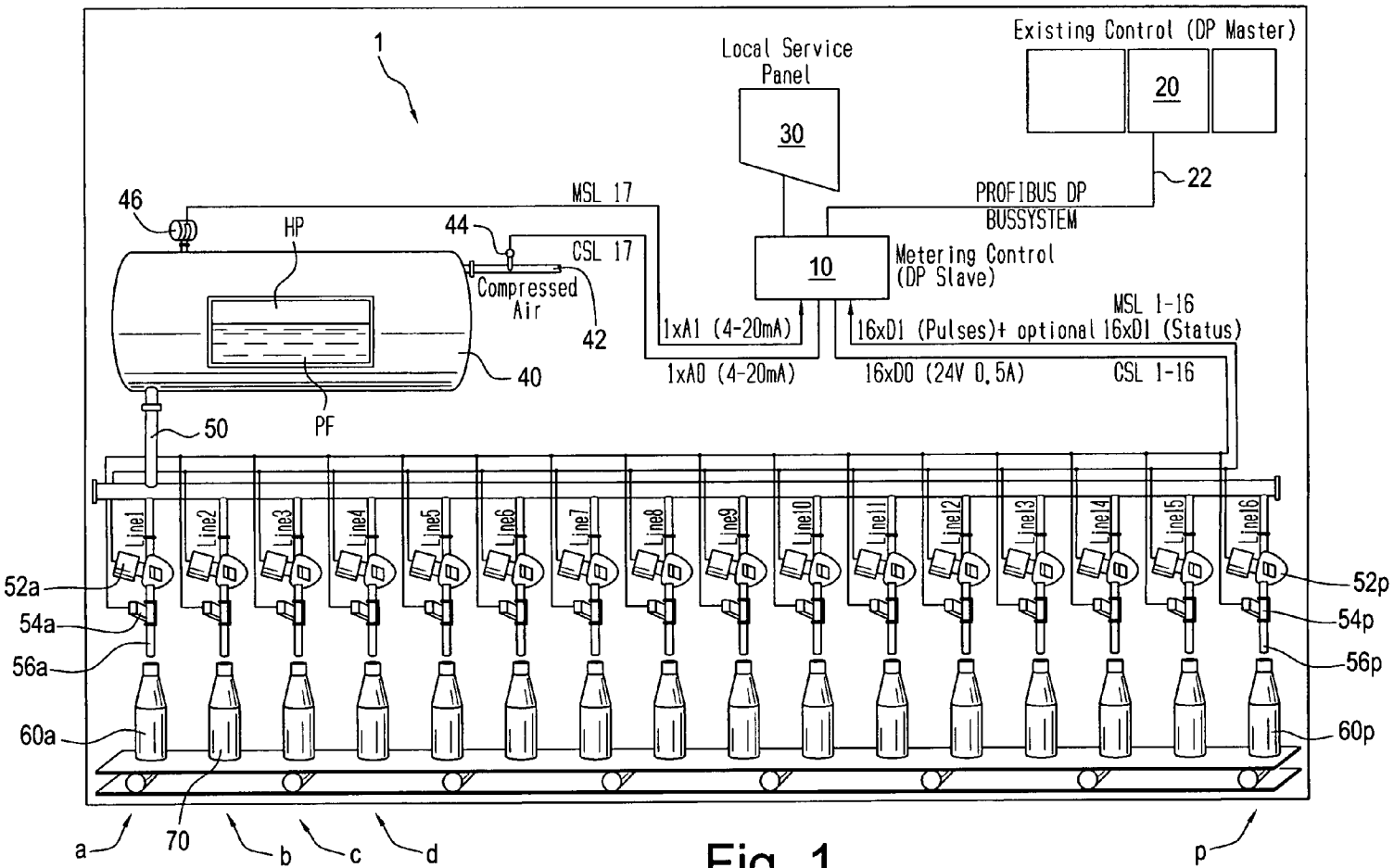
FIG. 1 is a typical filling system in schematic presentation.

FIG. 1 shows a typical filling system as used in various fields of industry. The liquid product P being filled (hair shampoo) is made available in a reservoir 40. Reservoir 40 is connected via a central supply line 50 with the individual filling stations a-p through branches labeled Line 1 to Line 16. For purposes of avoiding clutter, not all of the letters a-p are shown for the filling stations. Each filling station includes a flow measuring device 52, 52*a* to 52*p*, and a filling valve 54, 54*a* to 54*p*. Via valve tips 56, 56*a* to 56*p*, the product PF being filled is filled into the container 60, 60*a* to 60*p*, here shampoo bottles. The containers 60*a* to 60*p* are conveyed together via a conveyor belt 70 to the individual filling stations. The flow measuring devices 52 and the filling valves 54 are connected via signal lines, 16 control signal lines CSL1-CSL16 and 16 measurement signal lines MSL1-MSL16, with a metering control unit 10.

The metering control unit 10 is modularly constructed, and is composed of a power supply, a central computing unit, a Profibus DP slave-unit, a digital pulse-input-unit (16 times), a digital pulse-output-unit (16-times 24 V, 0.5 A) and a 4-20 mA unit (4-times AI, 2-times AO).

Via a bus connection line 22, the metering control unit 10 is connected with a central control unit 20. Communication between the metering control unit 10 and the central control unit 20 is accomplished according to the Profibus DP standard, with the metering control unit 10 functioning as a Profibus DP slave and the control unit 20 as a Profibus DP master. Control unit 20 controls the entire supply and removal of the containers 60 being filled at the individual filling stations a-p. The complete filling cycle for, in each case, 16 containers being filled, takes about 5 seconds.

The metering control unit 10 is, furthermore, connected with a local display unit 30 embodied as a touchscreen, via which configuring of the filling system occurs.

One obtains constant filling conditions only when the headspace pressure HP in the reservoir 40 is held constant. To achieve this, a pressure meter 46 is provided on the reservoir 40, for measuring the headspace pressure HP in the container 40. Via a pressurized-air supply line 42, in which a valve 44 is provided, the headspace pressure HP can be adjusted. The corresponding control of the headspace pressure is accomplished likewise via the metering control unit 10. For this, the current headspace pressure is transmitted as a 4-20 mA signal via the measurement signal line MSL 17 to the metering control unit 10. Via the control signal line CSL17, the metering control unit 10 appropriately operates the valve 44, for keeping the headspace pressure HP in the container 40 constant.

Figure 2:
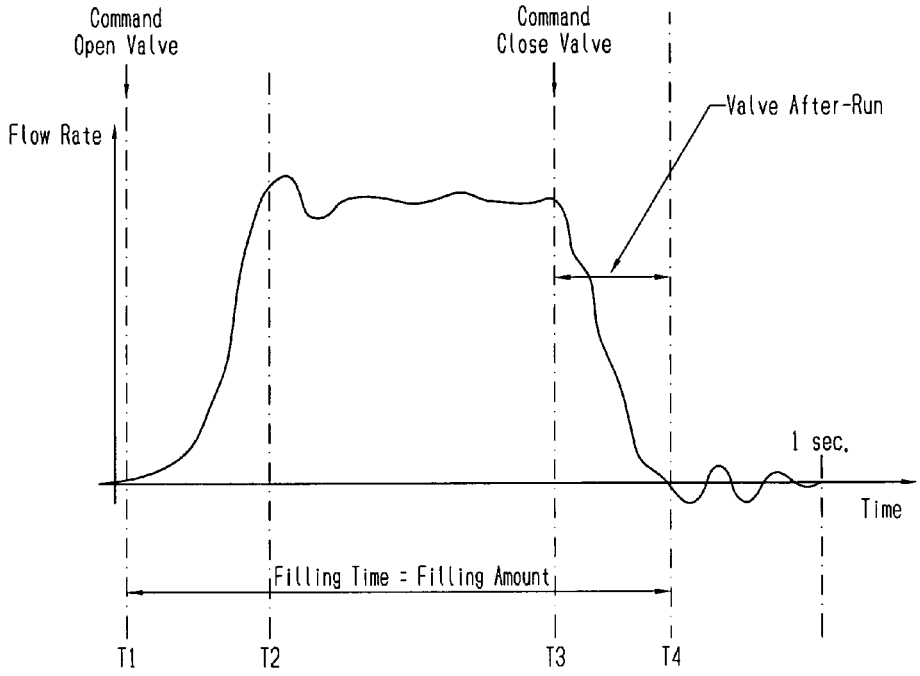
FIG. 2 is a filling curve of a filling station of the filling system.

FIG. 2 shows a typical filling curve for each of the filling stations a-p. Plotted is the flow rate at one of the filling tips as a function of time.

The desired amount of filling F is predetermined at the start-up of the filling system and stored in the metering control unit 10. The filling valve at each individual filling station is operated appropriately to achieve the amount of filling F.

The dot-dashed lines in FIG. 2 designate the following points in time: T1—open command from the metering control unit 10 to the filling valve 54*a* that the valve should begin opening; T2—filling valve 54*a* is completely open; T3—close command from the metering control unit 10 to the filling valve 54*a* that the valve should begin closing, since the desired amount of filling will be reached, taking into consideration the amount of after-run; T4—filling valve 54*a* is closed. The amount F of product PF filled into the container 60 equals, in principle, the area under the curve between the points in time T1 and T4 (about 0.5 sec)

Naturally, no mathematical integration of the filling curve takes place in the metering control unit 10. Simply the pulse values, which the flow measuring device delivers on its pulse output, are added up. If a certain limit value, corresponding to the amount of filling F minus the after-run amount, is reached, then the close command is sent to the pertinent filling valve. The after-run amount, i.e. the amount product which still flows the after the close command, is, thus, appropriately taken into consideration.

As evident from FIG. 2, the flow between the points in time T2—and T3, when the filling valve is completely open, is relatively constant. In this time range, the method of the invention is performed.

Figure 3:
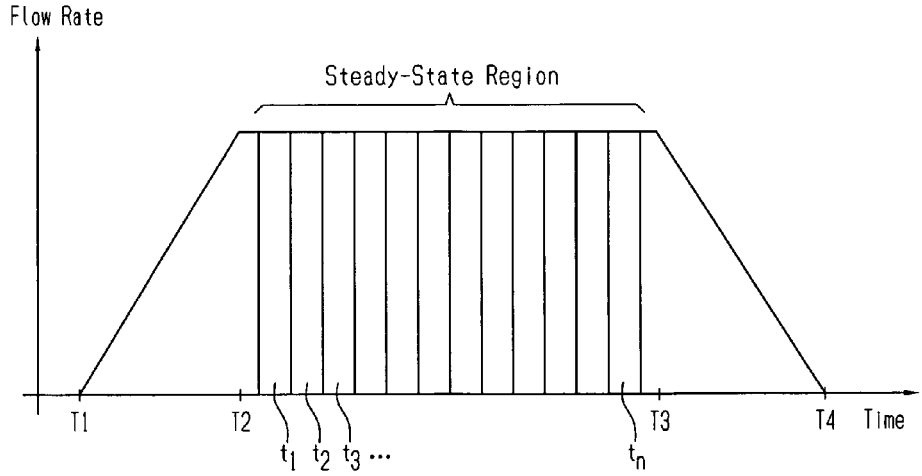
FIG. 3 is a simplified filling curve of FIG. 2.

FIG. 3 shows the filling curve of FIG. 2, strongly simplified. The method of the invention starts from the observation that the flow remains about constant between the points in time T2 and T3. This time range is divided into a number of time intervals t1 to tn. The entire filling event takes less than 1 second. The length of the time intervals t1 to tn is selectable between about 10-100 msec. For each time interval ti, the instantaneous flow value D(ti) can be given. The sum of all flow values D(ti) for i=1 to n equals the amount of filling F. The values D(ti) are checked for significant deviations. If a significant change is detected, then closing of the valve 44 at the pertinent filling station is initiated before the point in time T3. Significant deviations point, as a rule, to foam formation. By closing the pertinent filling valve, an overflow of the container being filled is prevented.

The invention starts from the observation that, between the points in time T2 and T3, the flow rate is about constant. The average value of the flow in this time range can be won, for example, by forming a sliding average of the values D(ti). The tolerance limit amounts to about ±5%. Such is application-specifically adjustable.

Since only the metering control unit 10 has the information concerning which time ranges should exhibit a constant flow, this simple air bubble detection cannot be performed by the flow measuring devices themselves.

The method of the invention is distinguished, above all, by its simplicity and its speed. With the method of the invention, a safe filling is also possible in the case of foaming products and fast filling events.

Contaminating of the filling system 1 due to over-fillings are safely prevented by the method of the invention.

TABLE 1

| | |
|---|---|
| filling stations | a-p |
| filling line | line 1-line 16 |
| filling installation | 1 |
| metering control unit | 10 |
| control | 20 |
| bus connection line | 22 |
| display unit | 30 |
| reservoir container | 40 |
| pressurized-air supply | 42 |
| valve | 44 |
| pressure meter | 46 |
| pressurized-air supply line | 50 |
| flow measuring device | 52a-52p□ |
| filling valve | 54a-54p |
| filling tips | 56a-56p |
| containers being filled (shampoo bottles) | 60a-60p |
| conveyor belt | 70 |
| fill quantity | F |

The invention claimed is:

1. A method for the safe filling of product in valve-controlled filling systems having, at individual filling stations, flow measuring devices for determining the amount of filling of product being filled, comprising the steps of:

opening a filling valve at a point in time T0;

determining a flow value D(ti) at the opened filling valve for a plurality of time intervals t1, t2, . . . tn;

checking the flow values D(ti) for significant deviations brought about by air bubble formation in the product being filled;

closing the filling valve at a point in time T1, when no significant deviations arise; and closing the filling valve at a point in time T1'≦T1, when significant deviations occur.

2. The method as claimed in claim 1, wherein:

the filling system has a plurality of filling stations, with, in each case, a flow measuring device and a filling valve.

3. The method as claimed in claim 2, wherein:

a filling event is only interrupted at a filling station where significant deviations occur.

4. The method as claimed in claim 1, wherein:

the flow measuring devices are Coriolis, or magneto-inductive, flow measuring devices.

5. The method as claimed in claim 1, wherein:

a time period between opening and closing of a filling valve amounts to about 1-5 seconds.

6. The method as claimed in claim 1, wherein:

an instantaneous flow value is determined via pulse values, which are output at a pulse output of the flow measuring device.

* * * * *